United States Patent [19]

Ford et al.

[11] 4,391,337

[45] Jul. 5, 1983

[54] HIGH-VELOCITY JET AND PROPELLANT FRACTURE DEVICE FOR GAS AND OIL WELL PRODUCTION

[76] Inventors: Franklin C. Ford, 3459 Edison Way, Fremont, Calif. 94538; Gilman A. Hill, 6200 Plateau Dr., Englewood, Colo. 80110; Coye T. Vincent, 1201 Eva Ave., Los Altos, Calif. 94022

[21] Appl. No.: 248,322

[22] Filed: Mar. 27, 1981

[51] Int. Cl.[3] ..... E21B 43/117

[52] U.S. Cl. ..... 175/4.6; 166/299; 102/286

[58] Field of Search ..... 175/4.6, 4.57, 4.58, 175/4.59; 166/299, 298, 297; 102/286, 289, 290, 306, 307, 310

[56] References Cited

U.S. PATENT DOCUMENTS

| | | | |
|---|---|---|---|
| 2,785,631 | 3/1957 | Blanchard | 175/4.6 |
| 3,713,487 | 1/1973 | Lozanski | 166/299 X |
| 4,253,523 | 3/1981 | Ibsen | 175/4.6 X |

OTHER PUBLICATIONS

"A New Perspective on Well Shooting—The Behavior of Contained Explosives and Deflagrations", Schmidt et al., (Sandia 1979).

"Small Scale Experiments with an Analysis to Evaluate the Effect of Tailored Pulse Loading on Fracture and Permeability", McHugh et al., (DOE 1980).

*Primary Examiner*—Ernest R. Purser
*Assistant Examiner*—Thuy M. Bui

[57] ABSTRACT

An integrated jet perforation and controlled propellant fracture device and method for enhancing production in oil or gas wells, wherein the device is inserted in a well bore to the level of a geological production structure; the fracturing device being constructed with a cylindrical housing of variable cross-section and wall-thickness with the housing filled with combustible propellant gas generating materials surrounding specially oriented and spaced shaped charges, having an abrasive material distributed within the propellant filled volume along the device length to produce enhanced perforations with attendant pressure-controlled gas and fluid injection into the perforations to produce controlled frac entry at point or points desired in the producing zones of the well bore, wherein a high velocity jet penetrates the production zone of the well bore initiating fractures, and is simultaneously followed by a high pressure propellant material which amplifies and propagates the jet initiated fractures.

9 Claims, 4 Drawing Figures

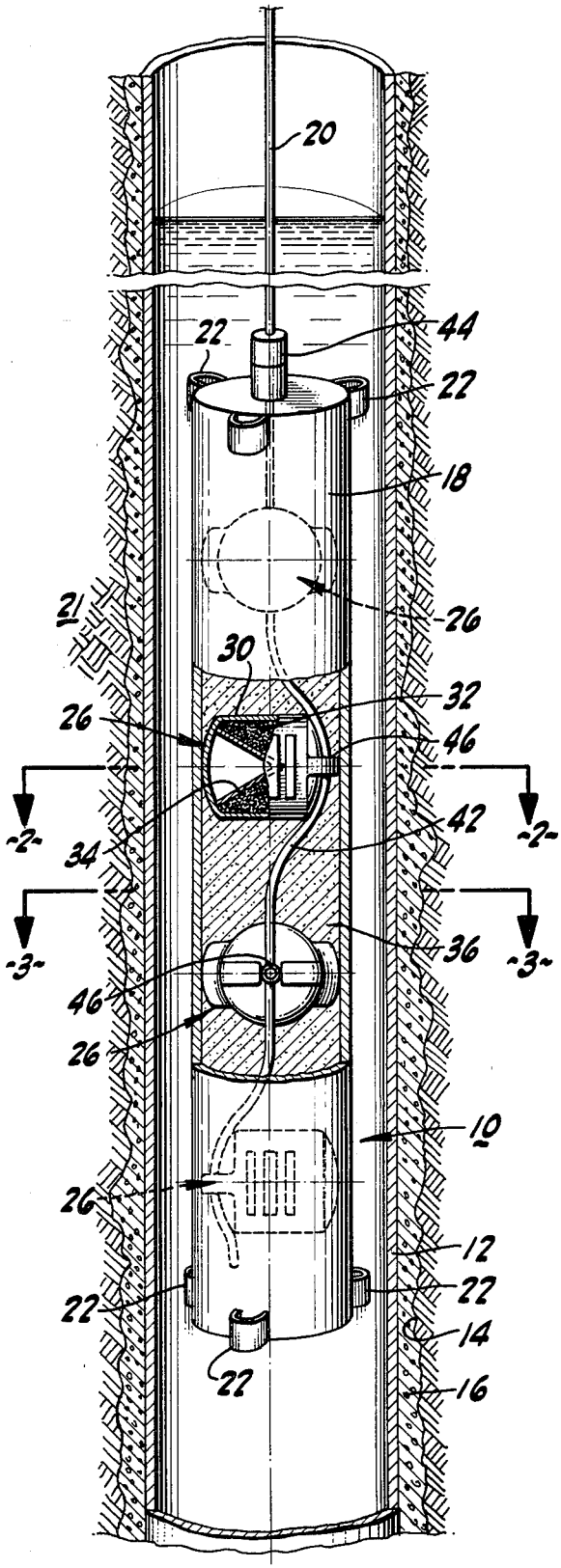
FIG-1
FIG-2
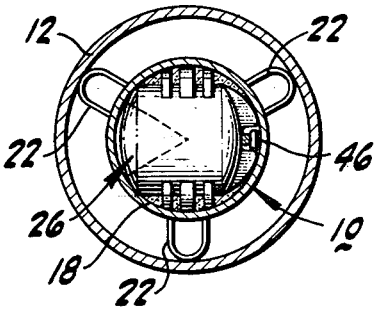
FIG-3
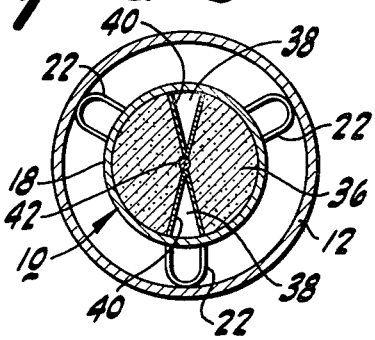
FIG-4
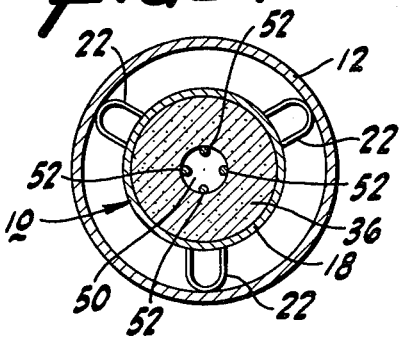

HIGH-VELOCITY JET AND PROPELLANT FRACTURE DEVICE FOR GAS AND OIL WELL PRODUCTION

BACKGROUND OF THE INVENTION

This invention relates to the field of oil and gas recovery and in particular to devices and methods for improving the production of new or existing wells by fracturing geological structures adjacent the well bore at the particular production zones in which flow to the well bore is to be stimulated.

In the past, the most common formation fracturing method for stimulating production has comprised the separate step method of projectile penetration of the production zone and hydraulic pressurization of the well using high pressure pumps to induce expansion or propagation of projectile initiated fractures. The substantial expense of preparing the well to receive the pumped fluid without collateral zone leakage and the time and expense of pumping fluids at the high pressures necessary for fracture expansion of the desired zones make this method unattractive for most low producers or multiple zone wells.

Gas propellants have been employed as a less expensive substitute to hydraulic fracture propagation. Again, the procedure has comprised the separate step method of projectile penetration of the production zone followed by a separate treatment with propellant devices. The separate step treatment using such techniques in cased wells has been almost exclusively perforated to the specifications of hydrafrac such that subsequent use of propellant frac requires an additional perforation step to provide adequate points of entry. Further, open hole treatments have rarely, if ever, used the perforation technique whether hydrafrac or propellant frac. The propellants have been generated by a variety of charge forms: pulsating charges, multiple point initiation of charges, uniformly burned charges, fast combustion (greater than sound speed in the well fluids), slow combustion (slower than sound speed in the well fluids), long cylindrical charges, short cylindrical charges, etc. These gas propellant charges have been used to expand zones previously perforated and have been successful.

It is a general object of this invention to provide a method and apparatus for stimulating oil or gas production in a drilled well that increases the effectiveness of propellant fracing at a substantial cost saving to the operator in both time and money. In using a gas propellant it is a further object to maximize the delivery potential of the propellant correlative to propagation of fracture and to maximize the effectiveness of the resultant fracture for enhanced production.

SUMMARY OF THE INVENTION

The integrated perforation and propellant fracturing device of this invention provides a relatively inexpensive way to enhance oil or gas production in new or existing wells by improving flow rates into the well bore. One or more of the devices are activated at the well depth levels where production zones are known to exist and where the production can be enhanced by fracturing geological structures adjacent the bore to relieve blockages and improve flow. A fluid head of several hundred feet is adequate to provide tamping equivalent to a packer but at greatly reduced cost.

The device comprises an integrated perforation and augmenting gas propellant fracturing device in which a high velocity penetrating jet is instantaneously followed by a high pressure gas propellant such that geological fracturing initiated by action of the penetrating jet is enhanced and propagated by the gas propellant. The gas propellant material is preferably a solid fuel or explosive-type material that has a controlled expansion rate generated by a burn configuration which generates a non-linear gas volume and pressure correlative to the propagated fracturization of geological zone into which it is introduced. An added enhancement, the propellant carries an abrasive material for both abrasively enlarging the avenues into which the propellant is expanded and forming a propping mechanism for inhibiting full collapse of the fractures or cracks after the pressure forces have dissipated.

In the preferred configuration, the propellant material and shaped charges are ignited along the axis of the housing simultaneously and the subsequent perforations produced by the shaped charges are closely followed by a simply tailored pressure pulse of gas generated by the propellant burning radially outward from axial ignition along its length. Radial burn results in the burned mass of propellant (and attendant local pressure rise), being proportional to radius of burned propellant ($R^2$) per unit time after initiation which produces a pressure profile capable of propagating fractures at the wellbore points of perforation. As the fractures try to propagate and admit gases and fluids from the well bore, the tailored pressure pulse rapidly supplies additional gas to assure properly increasing pressure during the expansion produced by the fractures. The number and size of perforations are controlled by the shaped charges of the apparatus but are determined in relation to the amount (and diameter) of the propellant used such that fewer holes are used for lower pressure (smaller) devices and more holes are used for higher pressure (larger) devices. Typical propellant materials burn at reasonably constant velocities in the velocity range of a few cms/sec within the pressure ranges required for extending fractures while the shaped charge devices function with typical burn rates of up to 25,000 ft/sec. Such widely different burn rates are utilized in the device design to permit the shaped charges to function normally as perforators and to complete their function while being immediately followed by the effect of the frac pressures produced by the gas-generating propellant materials in the immediate well bore area. Use of propellant augmentation permits operations at pressures well below the levels that would cause the formation materials to crush or undergo plastic flow (as in the case of explosives) but at loading rates sufficiently high to promote fracture growth to enhance the multiple mini-fractures produced by the shaped charges. Additional shaped charge enhancement is produced by the introduction of abrasive materials contained in the propellant charge, at time of fabrication of the device, which are driven at high velocity at the time perforations are effected. The abrasive materials erode the general perforation hole produced by the shaped charge, extend the fractures produced by the shaped charge, and inject substantial debris material produced by the eroion into the fractures to act as a proppant for the process. The perforation and fracturing device both perforates and fractures in a single operation using a combination of shaped charges and gas-generating propellants to define the point of fracture entry and to greatly extend the fractures by the application of pressures generated by the propellant gases to enhance injection of abrasive materials, gas, and fluids utilized in the well bore during operation of the device. In the preferred embodiment, venting passages down opposite sides of the cylindrical propellant pack are provided as a means of conveying the propellant generated gases from the central combustion zone to the periphery of the canister and thence into the well bore to develop the well bore pressures necessary for fracing.

BRIEF DESCRIPTION OF THE DRAWINGS

FIG. 1 is a perspective view partially in cross section of the jet perforation and controlled propellant fracture device located in an oil well.

FIG. 2 is a cross sectional view of the fracture device showing the arrangement of a jet grenade taken on the lines 2—2 in FIG. 1.

FIG. 3 is a cross sectional view of the fracture device showing the configuration of a propellant pack taken on the lines 3—3 in FIG. 1.

FIG. 4 is a cross sectional view of an alternate embodiment of the propellant pack of FIG. 3.

DETAILED DESCRIPTION OF THE PREFERRED EMBODIMENT

Referring to FIG. 1, the preferred embodiment of the integrated projectile perforation and controlled propellant fracture device, hereafter conveniently termed the fracing device, designated generally by the reference numeral 10, is shown in use in an oil well casing 12. The well casing 12 lines a well bore 14 between which is a grouted packing 16 which fills any existing voids. The fracing device is useable in any conventionally formed well bore, with or without a well casing, and is constructed with a housing 18 of suitable diameter according to the diameter of the well. The housing forms a canister of variable length depending on the spacing and number of points of penetration and fracture desired.

The canister 18 is lowered by a support and conductor wire 20 to the depth of the geological production zone 21 desired to be fractured. External, flexible alignment bosses 22 centrally locate the canister in the casing and adjust for any irregularities in the well casing or bore.

The well is filled with fluid to cover the canister to a depth of about fifty feet in order to provide the pressure head and hydraulic inertia necessary to insure proper direction of the jet and propellant charges and proper peak pressure cushioning in order to prevent unwanted damage to the well casing or bore. In this manner gas pressures are contained long enough for fractures to be initiated and driven into the formation.

As shown in the broken away section of the canister in FIG. 1, the canister 18 contains a plurality of spaced shaped charge grenades 26. In the embodiment shown, four grenades are depicted radially directed and oriented 90° out of phase with one another to enable launching of four projectiles in four different directions into the production zone 21. The grenades have a destructable glass casing 30 filled with an explosive charge 32 shaped around a deformable metal cone 34, which on detonation of the charge is turned inside out in a force extrusion process and is ejected as an elongated high velocity jet. The jet passes easily through the canister housing, the well casing and penetrates deep into the geological structure surrounding the bore.

Packed around the shaped charge grenades as shown also in FIG. 2, is a gas propellant material which is preferably a solid fuel type material with an oxidizer and an abrasive. Typical fuels include metal powders (Al, Mg, etc.) hydrocarbons (epoxies, plastics, etc.) and other reducing agent materials. Typical oxidizers include perchlorates, chlorates, nitrates, and other oxygen rich materials. Typical fillers and abrasives include sand, silicon carbide and other non-combustible particulate materials.

For example, in the embodiment shown, a metal powder and perchlorate with an abrasive filler and dilutent binder form a solid fuel pack 36 around shaped charge grenades and fill a majority of the space in the canister except for sector shaped voids 38. The voids 38 are maintained by paper retainer 40 at the time the fuel pack is formed and functions as an escape passage for burn gases from the ignited fuel pack. While not all fuel compositions may require the voids to vent gases to the voids formed by the detonated grenades, they are preferred as a safety feature to prevent extreme local pressure buildup and explosion. In the preferred embodiment of FIG. 3, the voids 38 are of sector configuration in cross section. In this manner, centrally ignited propellant can funnel gases to the wall of the container where they pass to the perforations and hence to the fractures generated by launched jets.

The fracing device 10 of FIG. 1 is detonated and ignited by a high velocity prima cord 42 which burns at the propagation velocity of explosive charges. Ignition from one end of the housing to the other is effected at a linear rate of about 25,000 ft/sec. or about 1/1000 of a second for a 25 foot long housing. The prima cord is fired by an ignition connector 44 which connects the electrical bridge wire 20 to the firing end of the prima cord 42.

The prima cord 42 is centrally located in the propellant pack 36 deviating only to connect to the detonator 46 at the end of each shaped charge grenade 26. Where large diameter housings are used, the grenades can be positioned such that the prima cord maintains a straight axial position throughout the fracing device.

The central location of the prima cord is important to initiate the radially outward burn pattern of the propellant. The high velocity ignition of the prima cord provides virtual simultaneous detonation of all of the shaped charge grenades along the entire length of the fracing device.

The radial burn is important for several reasons, i.e. it establishes the mass rate of burning per unit time as proportional to the radius (R) of the burn front, and the mass of propellant burned as proportional to burn front radius squared ($R^2$). Further, it eliminates any vertical thrust (up or down well) so that formation entry and fracing are precisely located together independent of device total burn time.

In end lighted propellant charges, depending on the burn velocity, the total burn time can be so large as to permit the propellant thrust to move the charge significant distances away from the initial charge location (and hence away from the preferred frac entry point).

The constant (or near constant) velocity of the radial direction burning of the propellant pack consumes propellant and creates gas induced pressures which have a pressure profile which varies roughly as the square of the burn front radius ($R^2$) until fracing occurs and the radial burn permits large quantities of propellant generated gases to be evolved quickly even after fracture has been initiated to allow fracture to be expanded and augmented. The pressure in the well bore builds up proportional to amount of propellant burned until the time of fracture initiation when gas expansion into the fractures reduces the pressure below that predicted for no expansion into the surrounding geological structures. The fluid head used to contain the propellant gases and provide a pressure limit is expanded up the well bore after an inertial lag, which further reduces pressure. Unless the radial burn mode is used, the expansions into the fracture zone and forced displacement of the water head may greatly reduce the available gas pressure for driving fractures away from the well bore.

For example, in a linear charge ignited at one end, the mass of burned propellant is roughly constant as a function of time. The pressure available to drive the fracs, once initiated, is dissipated by the expansion of the gas into the fractures and the more gradual expansion of the fluid head. The remaining pressure is not sufficient to drive the fractures as efficiently as the pressures developed by the radial burn of the present invention which programs the mass of burned propellant.

It is not the absolute value of mass burned, but rather, the programming of burned mass as a function of time which is of vital importance.

Rather than a linear dependance, the perf-frac device develops a mass burning profile according to the relations $$\Delta M = \pi \rho l\{2R\ V\Delta t + \overline{V\Delta t}^2\}$$

where ΔM is the increase in propellant mass per unit time interval Δt (proportional to R)

| | | |
|---|---|---|
| and | $M = \pi \rho l\{R^2\}$ | M = mass of propellant burned |
| where | $R = Vt$ | R = burn front radius |
| or | $M = \pi \rho l\{(Vt)^2\}$ | ρ = propellant density |
| | | V = burn velocity |
| | | l = tool length |
| | | Δt = time interval |
| | and | t = total time of burn |

It is to be understood that alternate means of igniting the propellant pack and detonating the shaped charge may be employed if the simultaneous or near simultaneous ignition and detonation occurs. For example, if an electrical thermal bridge wire is circuited through the propellant pack and connected to the detonators of each shaped charge, a simultaneous ignition and multiple detonation will occur. The concurrance of these two events enables the propellant gases to immediately follow the jet path and augment and extend the fractures initiated by the jet penetration. It is this close association that enables the gas propellant to achieve the results otherwise unobtainable by a delayed sequencing of detonation followed by ignition.

From the foregoing analysis of the burn pattern for centrally ignited systems, it can be appreciated that the fracing device can be tailored to the geological formation desired to be fractured both in the number of jet penetrations made and in the quantity of propellant delivered. Additionally, a number of fracing devices connected by a common ignitor system can be deployed opposite a number of discrete and separate production zones and operated simultaneously.

When properly designed, the number of shaped charges per foot will provide adequate penetrations into formation to control the pressure maximum produced by the propellant gases. This control results from expansion of well bore fluids and gases into the formation at the multiple points of perforation which reduces peak pressure in the well bore. On the other hand, when properly designed, the number of shaped charges per foot will determine the lower range of pressures to be generated by the propellant gases in the well bore. This control results from controlled expansion into formation by limiting the number of perforations available for initiating fractures. Further controls by selection of the propellant composition, the use of fillers or extenders and the design of vent voids provides design variables to meet a variety of well conditions. For example, as shown in FIG. 4, an axial void 50 of circular cross section with multiple surface ignitors 52 would rapidly provide a large volume of propellant gas shortly after ignition, and would continue a burn producing propellant mass at the desired $R^2$ rate.

Typical well completions today utilize spacings and perforation hole sizes required to adapt to hydraulic fracturing which is limited then to the pumping capacity of the surface pumps. As a result, one finds most wells completed with only one perf per foot and frequently only one perf per several feet. Since fluid entry to the well bore is obviously controlled by the number and size of perfs per foot, subject to adequate fracturing at each perf, it is highly advantageous when attempting to optimize well production to produce as many fractures and perforations in the production zone as is feasible with existing technology. The present apparatus provides design control such that the number of perforations and local fractures near the well bore can be many multiples of those currently available by the use of standard completion techniques and can be tailored to the particular geological formations encountered.

While the above described device and method of geological fracturing is primarily used in the oil and gas industry to improve production of a well, application for other uses may be apparent where economically feasible. For example, where water is scarce and locked in geological formations, the device and method are useable to loosen water bearing zones to increase the flow of water into a water well.

While in the foregoing specification embodiments of the invention have been set forth in considerable detail for the purposes of making a complete disclosure of the invention, it should be apparent to those of ordinary skill in the art that numerous changes may be made in such details without departing from the spirit and principles of the invention.

What is claimed is:

1. An integrated jet perforation and controlled propellant fracture device for use in combination with a conventional tamping means to enhance gas and liquid wells by perforating and fracturing well formation materials comprising:

a housing having suspension means for locating said housing at a predetermined location in a well;

at least one jet perforation unit contained in said housing having a launchable projectile jet and an explosive charge means for launching said projectile jet;

a controlled-burn, gas propellant material contained in said housing proximate said jet perforation unit; and firing means for igniting said propellant material and detonating said charge means in a substantially simultaneous manner, said propellant material having the characteristic on ignition of generating gases which instantaneously follow said jet, said gases having a pressure pulse to augment and enhance fractures in a geological structure around the well which are initiated by said jet, wherein in use in a well having tamping means said device is constructed and arranged to produce gases having a pressure pulse peak below the plastic flow limit of the well formation materials.

2. The jet perforation and controlled propellant fracture device of claim 1 wherein said housing has a cylindrical configuration with a central axis; said gas propellant material is contained in said housing and has a substantially cylindrical containment configuration conforming in general to the configuration of the housing; and, said firing means for igniting said propellant material and detonating said charge includes an ignition element means located substantially along the central axis of the housing for igniting said gas propellant material along the central axis for non-linear generation of propellant gases.

3. The perforation and fracture device of claim 2 wherein said propellant material has added thereto an abrasive material for erroding debris from the well formation material to form a propant for generated fractures.

4. The perforation and fracture device of claim 3 wherein said propellant material is formed in a solid pack with at least one predefined void providing passage of propellant gas on ignition to follow said jet.

5. The perforation and fracture device of claim 4 wherein said void comprises a sector shaped void from the central axis of said housing to said housing substantially along the length of said housing.

6. The perforation and fracture device of claim 4 wherein the amount of propellant burned on ignition increases with time proportional to at least the radius squared of a centrally located burn pattern to provide optimum pressure to enhance fracturing.

7. The perforation and fracture device of claim 1 wherein said housing contains a plurality of spaced jet perforation units along the length of the housing, each jet perforation unit being directed radially outward in a different radial direction.

8. The perforation and fracture device of claim 7 wherein the number of jet perforation units and the amount and configuration of propellant material used are determined to provide propellant gas at high pressure for optimum fracture augmentation to said perforation jet with minumum damage to the well.

9. A method for perforating and fracturing production zones of well formation material in a well comprising the steps of:

(a) lowering a jet perforation and controlled propellant fracture device into a well to the production zone, said device comprising:

(i) a housing containing a jet perforation unit with a launchable jet and an explosive charge means for launching said jet said housing further containing a controlled-burn, gas propellant material proximate said jet perforation unit; and (ii) a firing means for detonating said explosive charge means and in a substantially simultaneous manner igniting said gas propellant material, said gas propellant material having the characteristic on ignition of generating gases with a pressure pulse having a pressure peak below the plastic flow limit of the well formation material;

(b) filling the well with fluid to a level at least twenty feet above said projectile perforation and controlled propellant fracture device; and (c) firing said jet perforation and controlled propellant fracture device wherein said well formation material is perforated and fractured.

* * * * *